US005445747A

United States Patent [19]

Kvietok et al.

[11] Patent Number: 5,445,747

[45] Date of Patent: Aug. 29, 1995

[54] CELLULASE FABRIC-CONDITIONING COMPOSITIONS

[75] Inventors: Lisa L. Kvietok, Wilmington; Toan Trinh, Maineville; Judith A. Hollingshead, Batavia, all of Ohio

[73] Assignee: The Procter & Gamble Company, Cincinnati, Ohio

[21] Appl. No.: 286,729

[22] Filed: Aug. 5, 1994

[51] Int. Cl.[6] ..... D06M 16/00; D06M 13/46

[52] U.S. Cl. ..... 252/86; 252/87; 252/875; 252/88; 252/89; 252/174.12

[58] Field of Search ..... 252/8.6, 8.8, 174.12, 252/DIG. 12, 8.7, 8.75, 8.9, 174.11

[56] References Cited

U.S. PATENT DOCUMENTS

| | | | |
|---|---|---|---|
| 3,861,870 | 1/1975 | Edwards et al. | 8/115.6 |
| 3,886,075 | 5/1975 | Bernardino | 252/8.75 |
| 3,954,630 | 5/1976 | Ramachandran | 252/8.6 |
| 3,974,076 | 8/1976 | Wiersema et al. | 252/8.8 |
| 4,137,180 | 1/1979 | Naik et al. | 252/8.8 |
| 4,233,164 | 11/1980 | Davis | 252/8.8 |
| 4,237,016 | 12/1980 | Rudkin et al. | 252/8.8 |
| 4,308,151 | 12/1981 | Cambre | 252/8.8 |
| 4,401,578 | 8/1983 | Verbruggen | 252/8.8 |
| 4,435,307 | 3/1984 | Barbesgaard et al. | 252/174.12 |
| 4,439,335 | 3/1984 | Burns | 252/8.75 |
| 4,479,881 | 10/1984 | Tai | 252/8.8 |
| 4,623,471 | 11/1986 | Wilsberg | 252/8.8 |
| 4,636,328 | 1/1987 | Flynn et al. | 252/90 |
| 4,648,979 | 3/1987 | Parslow et al. | 252/8.8 |
| 4,661,269 | 4/1987 | Trinh et al. | 252/8.8 |
| 4,661,289 | 4/1987 | Parslow et al. | 252/547 |
| 4,738,682 | 4/1988 | Boegh et al. | 8/401 |
| 4,767,547 | 8/1988 | Straathof et al. | 252/8.8 |
| 4,790,856 | 12/1988 | Wixon | 8/137 |
| 4,806,260 | 2/1989 | Broze et al. | 252/8.8 |
| 4,818,421 | 4/1989 | Boris et al. | 252/8.8 |
| 4,818,422 | 4/1989 | Adams et al. | 252/8.8 |
| 4,828,723 | 5/1989 | Cao et al. | 252/8.8 |
| 4,915,854 | 4/1990 | Mao et al. | 252/8.8 |
| 4,960,526 | 10/1990 | Puentes-Bravo et al. | 252/8.8 |
| 5,004,556 | 4/1991 | Julemont et al. | 252/99 |
| 5,093,014 | 3/1992 | Neillie | 252/8.8 |
| 5,120,463 | 6/1992 | Bjork et al. | 252/174.12 |
| 5,156,761 | 10/1992 | Aaslyng et al. | 252/174.12 |
| 5,202,045 | 4/1993 | Karpusiewicz et al. | 252/90 |
| 5,213,581 | 5/1993 | Olson et al. | 8/401 |
| 5,232,851 | 8/1993 | Cox et al. | 435/263 |
| 5,234,610 | 8/1993 | Gardlik et al. | 252/8.6 |
| 5,238,843 | 8/1993 | Carpenter et al. | 435/264 |
| 5,246,853 | 9/1993 | Clarkson et al. | 435/263 |
| 5,254,283 | 10/1993 | Arnold et al. | 252/174.12 |
| 5,290,474 | 3/1994 | Clarkson et al. | 252/174.12 |
| 5,290,475 | 3/1994 | Wixon | 252/174.23 |

FOREIGN PATENT DOCUMENTS

| | | | |
|---|---|---|---|
| 173397 | 3/1986 | European Pat. Off. . | |
| 269168 | 6/1988 | European Pat. Off. . | |
| 350098 | 1/1990 | European Pat. Off. . | |
| 409504 | 1/1991 | European Pat. Off. | 252/8.8 |
| 486113 | 5/1992 | European Pat. Off. | 252/8.8 |
| 239910 | 10/1992 | European Pat. Off. . | |
| 507478 | 10/1992 | European Pat. Off. | 252/8.8 |
| 58-36217 | 3/1983 | Japan . | |
| 58-54082 | 3/1983 | Japan . | |
| 63-6098 | 1/1988 | Japan . | |
| 10/40681A | 10/1989 | Japan . | |
| 1368599 | 10/1974 | United Kingdom . | |
| 2075028 | 11/1981 | United Kingdom . | |
| 2094826 | 9/1982 | United Kingdom . | |
| 2095275 | 9/1982 | United Kingdom . | |
| 2258655 | 2/1993 | United Kingdom . | |
| 91/13136 | 9/1991 | WIPO . | |
| 91/17243 | 11/1991 | WIPO . | |
| 93/12224 | 6/1993 | WIPO . | |

OTHER PUBLICATIONS

Chemical Abstract Service vol. 107:156217q (1987).

*Primary Examiner*—Anthony Green
*Attorney, Agent, or Firm*—Robert B. Aylor

[57] ABSTRACT

Fabric softening compositions comprising fabric softening active(s), preferably cationic and/or nonionic fabric softening actives; cellulase; and an effective amount of perfume comprising certain selected ingredients and being substantially free of other specific perfume ingredients, to cover an off-odor that occurs on fabric treated with said softening compositions. The compositions preferably have a low pH and can also contain free radical scavenging antioxidant material and/or chelant to stabilize the cellulase.

20 Claims, No Drawings

CELLULASE FABRIC-CONDITIONING COMPOSITIONS

TECHNICAL FIELD

The present invention relates to fabric-conditioning compositions to be used in the rinse cycle of laundry washing processes, in order to impart softness as well as fabric appearance benefits to fabrics, said compositions comprising fabric softening active(s), cellulase, and perfume.

BACKGROUND OF THE INVENTION

Fabric conditioning compositions, in particular fabric softening compositions to be used in the rinse cycle of laundry washing processes, are well known. Typically, such compositions contain a water-insoluble quaternary-ammonium fabric softening agent, the most commonly used having been di-long alkyl chain ammonium chloride.

The anti-harshening effect of cellulase on fabrics is known from e.g. FR 2 481 712 or GB-A-1 368 599, and cellulase's fabric care benefits, are disclosed in, e.g., EPA 269 168, all incorporated herein by reference in their entirety. Cellulases have been mainly described, however, for use in detergent compositions to be used in the main wash cycle of laundry processes, and have found some commercial application in this context.

The use of cellulases in rinse added fabric softener compositions has apparently been commercially pursued only recently. Potential issues which appear to be resolved include the provision of acceptable stability of the cellulase in such compositions upon storage; the effectiveness of cellulase use in the rinse cycle following a normal detergent wash cycle despite the fact that the rinse cycle conditions are typically of shorter duration and lower temperatures than used in the wash cycle; and the resolution of concerns around the potential for fabric damage if too high cellulase activity is present in the rinse cycle, e.g., by carry over of cellulase activity from cellulase-containing detergents in the wash cycle.

It has previously been discovered that rinse added fabric softener compositions can be formulated to provide cellulase activity within certain limits during normal use conditions so as to provide fabric softening benefits with an acceptable impact on fabric wear. It has also been found that cellulase in fabric softener compositions at low pH is remarkably stable and that cellulase is further stabilized for storage by the addition of antioxidants and/or chelants. Formulation of fabric softening compositions can be accomplished over the entire typical pH range of fabric softening agents, including pH of 5 to 7 for traditional fabric softening actives, while achieving both effectiveness and fabric safety benefits following prolonged storage.

SUMMARY OF THE INVENTION

The present invention is based upon the surprising discovery of a problem that has not heretofore been recognized. Specifically, fabric softening compositions containing cellulase, even at the low levels needed for effectiveness, are associated with a distinct odor that is not considered acceptable. Furthermore, surprisingly, the odor has a character that is made more objectionable by the presence of certain common perfume ingredients. This odor is detected on the treated fabrics even when the odor is not detectable in the neat composition and in order to cover the odor the perfume must be properly selected and used at an effective level. However, the odor can be covered by the use of other common perfume ingredients, as described hereinafter, which include fabric substantive perfume ingredients and certain more volatile perfume ingredients, which provide overall product, wet fabric and dry fabric perfume odor characteristics that are highly acceptable to the majority of consumers. The present invention relates to fabric conditioning compositions comprising one or more cationic and/or nonionic fabric softening agents, cellulase, and an effective amount of substantive perfume that provides odor control on the fabrics. Preferred compositions have cellulase present at a level such that the compositions deliver an effective amount of cellulase below about 50 CEVU's per liter of rinse solution during normal washing rinse cycle use conditions; and, when the compositions are aqueous, or are converted into aqueous compositions, have low pH; and/or have stabilizing amounts, e.g., an antioxidant effective amount, of material selected from the group consisting of free radical scavenging antioxidant materials, chelants, and mixtures thereof.

DETAILED DESCRIPTION OF THE INVENTION

The Cellulase

The cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of *Humicola insolens* (*Humicola grisea* var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention can be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labeled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens,* DSM 1800, or which is homologous to said 43 kD endoglucanase.

The cellulases herein should be used in the fabric-conditioning compositions of the present invention at a level equivalent to an activity from about 0.1 to about 125 CEVU/gram of composition [CEVU=Cellulase (equivalent) Viscosity Unit, as described, for example, in WO 91/13136, incorporated herein by reference in its entirety, wherein it is disclosed that CEVU is a standard term defined by one of the manufacturers of cellulases, Novo Nordisk A/S, Novo alle, DK-2800 Bagsvaerd, Denmark, specifically in AF 253/2-GB, available on request], and most preferably about 5 to about 100. Such levels of cellulase are selected to provide the herein preferred cellulase activity at a level such that the compositions deliver a fabric softening effective amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 1 CEVU to about 50 CEVU's per liter rinse solution, more preferably from about 2 CEVU's to about 30 CEVU's per liter, even more preferably from about 5 CEVU's to about 25 CEVU's per liter, and most preferably from about 10 CEVU's to about 20 CEVU's per liter.

The Cationic or Nonionic Fabric Softening Agents

The preferred fabric softening agents to be used in the present invention compositions are quaternary ammonium compounds or amine precursors herein having the formula either (I) or (II), below:

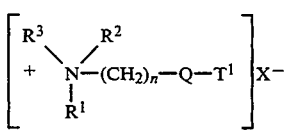

(I)

or

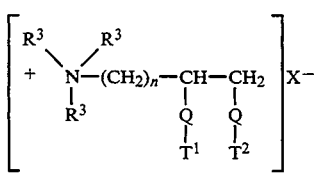

(II)

Q is —O—C(O)— or —C(O)—O— or —O—C(O)—O— or —$NR^4$—C(O)— or—C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

each $T^1$, $T^2$, $T^3$, $T^4$, and/or $T^5$ is (the same or different) $C_{11}$–$C_{23}$ alkyl or alkenyl;

n and m are integers from 1 to 4; and $X^-$ is a softener-compatible anion.

The alkyl, or alkenyl, chains $T^1$, $T^2$, $T^3$, $T^4$, and/or $T^5$ should contain at least 11 carbon atoms, preferably at least 15 carbon atoms. The chain can be straight or branched.

Tallow is a convenient and inexpensive source of long chain alkyl and alkenyl material. The compounds wherein $T^1$, $T^2$, $T^3$, $T^4$, and/or $T^5$ represents the mixture of long chain materials typical for tallow are particularly preferred.

Specific examples of quaternary ammonium compounds suitable for use in the aqueous fabric softening compositions herein include:

1 ) N,N-di(tallowoyl-oxyethyl)-N,N-dimethyl ammonium chloride;

2) N,N-di(tallowoyl-oxyethyl)-N-methyl, N-(2-hydroxyethyl) ammonium chloride;

3) N,N-di(tallowalkyloxy-carboxymethyl)-N,N-dimethyl ammonium chloride;

4) N,N-di(2-tallowyloxyacetoxyethyl)-N,N-dimethyl ammonium chloride;

5) N-(2-tallowoyl-oxyethyl)-N-(tallowalkyloxy-carboxymethyl) -N,N-dimethyl ammonium chloride;

6) N,N,N-tri(tallowyl-oxyethyl)-N-methyl ammonium chloride;

7)N-(tallowalkyloxy-carboxymethyl)-N-(tallowalkyl-N,N-dimethylammonium chloride; and 8) 1,2-ditallowyl oxy-3-trimethylammoniopropane chloride; and mixtures of any of the above materials.

Of these, compounds 1–7 are examples of compounds of Formula (I); compound 8 is a compound of Formula (II).

Particularly preferred is N,N-di(tallowoyl-oxyethyl)-N,N-dimethyl ammonium chloride, where the tallow chains are at least partially unsaturated. The level of unsaturation of the tallow chain can be measured by the Iodine Value (IV) of the corresponding fatty acid, which in the present case should preferably be in the range of from 5 to 100 with two categories of compounds being distinguished, one having an IV below, and the other having an IV above, 25.

Indeed, for compounds of Formula (I) made from tallow fatty acids having a IV of from about 5 to about 25, preferably from about 15 to about 20, it has been found that a cis/trans isomer weight ratio greater than about 30/70, preferably greater than about 50/50 and more preferably greater than about 70/30 provides optimal concentratability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coconut, palm, lauryl, oleyl, ricinoleyl, stearyl, palmityl, or the like, said fatty acyl chains being either fully saturated, or preferably at least partly unsaturated;

replacing "methyl" in the above compounds with ethyl, hydroxyethyl, propyl, hydroxypropyl, isopropyl, butyl, isobutyl, or t-butyl;

replacing "chloride" in the above compounds with bromide, methylsulfate, ethylsulfate, methylsulfonatec, ethylsulfonate, formate, acetate, citrate, benzoate, sulfate, phosphate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines preferably being substantially protonated in the liquid compositions due to the stabilizing pH values.

The quaternary ammonium or protonated amine precursor compounds herein are present at levels of from about 1% to about 80% of compositions herein, depending on the composition execution which can be dilute with a preferred level of active from about 5% to about 15%, or concentrated, even particulate, with preferred levels of active from about 15% to about 50%, most preferably from about 15% to about 35%.

For the preceding fabric softening agents which contain ester linkages, the pH of the compositions herein is an essential parameter of the present invention. Indeed, pH influences the stability of both the quaternary ammonium and/or amine precursor compounds, and of the cellulase, especially in prolonged storage conditions.

The pH, as defined in the present context, is measured in the neat compositions, in the continuous phase after separation of the dispersed phase by ultra centrifugation, at 20° C. For optimum hydrolytic stability of these compositions, the neat pH, measured in the above-mentioned conditions, must be in the range of from about 2.0 to about 4.5, preferably from about 2.0 to about 3.5. The pH of these compositions herein can be regulated by the addition of Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Nonionic fabric softening materials/agents also useful in the present compositions, preferably in combination with cationic softening agents. Typically, such nonionic fabric softener materials have an HLB of from about 2 to about 9, more typically from about 3 to about 7. Such nonionic fabric softener materials tend to be readily dispersed, either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the dispersibility improving materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2, fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with the trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos. 3,861,870, Edwards and Diehl; No. 4,308,151, Cambre; No. 3,886,075, Bernardino; No. 4,233,164, Davis; No. 4,401,578, Verbruggen; No. 3,974,076, Wiersema and Rieke; and No. 4,237,016, Rudkin, Clint, and Young, all of said patents being incorporated herein by reference.

For example, suitable fabric softener agents useful herein can comprise one, two, or all three of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one said group and an arylalkyl group (preferably from about 10% to about 80%);

with said (a), (b) and (c) preferred percentages being by weight of the fabric softening agent component of the present invention compositions.

The general descriptions of the preceding (a), (b), and (c) softener ingredients (including certain specific examples which illustrate, but do not limit the present invention) can be found in the specification of U.S. Pat. No. 4,661,269, incorporated hereinbefore by reference.

One variation of Component (a) is commercially available as Mazamide® 6, sold by Mazer Chemicals, or Ceranine® HC, sold by Sandoz Colors & Chemicals. Another example of Component (a) is stearic hydroxyethyl imidazoline sold under the trade names of Alkazine® ST by Alkaril Chemicals, Inc., or Schercozoline® S by Scher Chemicals, Inc. Yet other examples of Component (a) are N,N''-ditallowalkoyldiethylenetriamine and 1-tallowamidoethyl-2-tallowimidazoline. All of said variations are described in said U.S. Pat. No. 4,661,269.

Components (a)(iii) and (a)(v), as described in the '269 patent, can be first dispersed in a Bronsted acid dispersing aid having a pKa value of not greater than about 4; provided that the pH of the final composition is not greater than about 5. Some preferred dispersing aids are hydrochloric acid, phosphoric acid, and/or methylsulfonic acid.

Both N,N''-ditallowalkoyldiethylenetriamine and 1-tallow(amido ethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January, 1978, pages 118–121 ). N,N''-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Examples of Component (b) are the monoalkyltrimethylammonium salts such as monotallowtrimethylammonium chloride, mono(hydrogenated tallow)trimethylammonium chloride, palmityltrimethyl ammonium chloride and soyatrimethylammonium chloride, sold by Sherex Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred. Other examples of Component (b) are behenyltrimethylammonium chloride, sold under the trade name Kemamine® Q2803-C by Humko Chemical Division of Witco Chemical Corporation; soyadimethylethylammonium ethylsulfate, sold under the trade name Jordaquat® 1033 by Jordan Chemical Company; and methyl-bis(2-hydroxyethyl-)octadecylammonium chloride, available under the trade name Ethoquad® 18/12 from Armak Company.

Yet another example of Component (b) is 1-ethyl-1-(2-hydroxy ethyl)-2-isoheptadecylimidazolinium ethylsulfate, available from Mona Industries, Inc., under the trade name Monaquat® ISIES; mono(tallowoyloxyethyl) hydroxyethyldimethylammonium chloride, i.e., monoester of tallow fatty acid with di(hydroxyethyl)-dimethylammonium chloride.

Examples of Component (c) are the well-known dialkyldi methylammonium salts such as ditallowdimethylammonium chloride, ditallowdimethylammonium methylsulfate, di(hydrogenated tallow)dimethylammoniumchloride, distearyldimethylammonium chloride, dibehenyldimethylammoniumchloride. Di(hydrogenated tallow)di methylammoniumchloride and ditallowdimethylammonium chloride are preferred. Examples of commercially available dialkyldimethyl ammonium salts usable in the present invention are di(hydrogenated tallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride, sold under the trade name Kemamine Q-2802C by Humko Chemical Division of Witco Chemical Corporation.

Other examples of Component (c) are methylbis(tallowamido ethyl)(2-hydroxyethyl)ammonium methylsulfate and methylbis(hydrogenated tallowamidoethyl)(2-hydroxyethyl)ammonium methylsulfate (these materials being available from Witco Chemical Company under the trade names Varisoft® 222 and Varisoft® 110, respectively); dimethylstearylbenzyl ammonium chloride, sold under the trade names Varisoft® SDC by Witco Chemical Company and Ammonyx® 490 by Onyx Chemical Company; and 1-methyl-1-tallowamido ethyl-2-tallowimidazolinium methylsulfate and 1-methyl-1-(hydrogenated tallowamidoethyl)-2-(hydrogenated tallow)imidazolinium methylsulfate (sold under the trade names VarisoftR 475 and VarisoftR 445, respectively, by Witco Chemical Company).

Preferred softening compounds are biodegradable. These preferred compounds can be considered to be diester variations of ditallow dimethyl ammonium chloride (DTDMAC), which is a widely used fabric softener.

The following are non-limiting examples of (c) (wherein all long-chain alkyl substituents are straight-chain):

$$[CH_3]_2{}^+N[CH_2CH_2OC(O)R^2]_2Cl^-$$

$$[HOCH(CH_3)CH_2][CH_3]^+N[CH_2CH_2OC(O)C_{15}H_{31}]_2Br^-$$

$$[C_2H_5]_2{}^+N[CH_2CH_2OC(O)C_{17}H_{35}]_2Cl^-$$

$$[CH_3][C_2H_5]^+N[CH_2CH_2OC(O)C_{13}H_{27}]_2I^-$$

$$[C_3H_7][C_2H_5]^+N[CH_2CH_2OC(O)C_{15}H_{31}]_2{}^-SO_4CH_3$$

$$[CH_3]_2{}^+N(-CH_2CH_2OC(O)C_{15}H_{31})(-CH_2CH_2OC(O)C_{17}H_{35})Cl^-$$

$$[CH_2CH_2OH][CH_3]^+N[CH_2CH_2OC(O)R^2]_2Cl^-$$

where $-C(O)R^2$ is derived from soft tallow and/or hardened tallow fatty acids. Especially preferred is diester of soft and/or hardened tallow fatty acids with di(hydroxyethyl)dimethylammonium chloride, also called di(tallowoyloxyethyl) dimethylammonium chloride.

Since the foregoing ester compounds (especially diesters, "DEQA") are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. Ranges of pH for making stable softener compositions containing diester quaternary ammonium fabric softening compounds are disclosed in U.S. Pat. No. 4,767,547, Straathof and Konig, issued Aug. 30, 1988, and is incorporated herein by reference.

The diester quaternary ammonium fabric softening compound (DEQA) of (c) can also have the general formula:

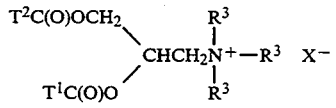

wherein each $T^1$, $T^2$ $R^3$, and $X^-$ have the same meanings as before. Such compounds include those having the formula:

$$[CH_3]_3{}^+N[CH_2CH(CH_2OC(O)T^1)OC(O)T^2]\ Cl^-$$

where $—OC(O)T^2$ and $—OC(O)T^1$ are derived from soft tallow and/or hardened tallow fatty acids.

Preferably each $R^3$ is a methyl or ethyl group and preferably each T is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, sulphate, and methyl sulphate; the anion can carry a double charge in which case $X^-$ represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

A suitable composition contains Component (a) at a level of from about 10% to about 80%, Component (b) at a level of from about 3% to about 40%, and Component (c) at a level of from about 10% to about 80%, by weight of the fabric softening component of the present invention compositions. A more preferred composition contains Component (c) which is selected from the group consisting of: (i) di(hydrogenated tallowalkyl)-dimethylammonium chloride; (v) methyl-1-tallowoylamidoethyl-2-tallowimidazolinium methylsulfate; (vii) diethanol ester dimethylammonium chloride; and mixtures thereof.

Another suitable composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallowalkyl)trimethyl ammonium chloride present at a level of from about 3% to about 30% by weight of the fabric softening component of the present invention compositions; Component (c): selected from the group consisting of di(hydrogenated tallowalkyl)dimethylammonium chloride, ditallowalkyldimethylammonium chloride, methyl-1-tallowoylamidoethyl-2-tallowimidazolinium methylsulfate, diethanol ester dimethylammonium chloride, and mixtures thereof; wherein Component (c) is present at a level of from about 20% to about 60% by weight of the fabric softening component of the present invention compositions; and wherein the weight ratio of said di(hydrogenated tallowalkyl)dimethylammonium chloride to said methyl-1-tallowoylamido ethyl-2-tallowimidazolinium methylsulfate is from about 2:1 to about 6:1.

The above individual components can also be used individually, especially those biodegradable materials, e.g., the di-(tallow fatty acid ester of hydroxyethyl)-dimethylammonium chloride).

As discussed hereinbefore, the anion $X^-$ provides charge neutrality.

The amount of fabric softening agent (fabric softener) in liquid compositions of this invention is typically from about 2% to about 50%, preferably from about 4% to about 30%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

The Perfume

The compositions of the present invention also contain perfume to cover the undesirable note associated with cellulase, especially the notes that are believed to be imparted to fabrics by the cellulase. The mechanism by which the odor is created is not known. However, in order to mask the notes, it is necessary to have a perfume of the right composition that is substantive. Preferably the perfume also acts as a "scent signal" in the form of a pleasant odor which signals the masking of the malodor on the fabrics.

It is essential that the perfume be added at an effective level to provide adequate odor control. Typically, the perfume is added at a level of from about 0.1% to about 5%, preferably from about 0.2% to about 3%, more preferably from about 0.3% to about 2%.

Although any type of perfume can be incorporated into the composition of the present invention, there are only a limited number of perfume ingredients from the thousands of perfume ingredients normally used by perfumers that have the proper characteristics of both odor and substantivity to provide masking for the note created by the presence of the cellulase and to create a fresh fabric impression.

At least about 25%, preferably at least about 50%, more preferably at least about 75%, by weight of the perfume is composed of fragrance material selected from the group consisting of: aromatic and aliphatic esters having molecular weights of from about 120 to about 250; aliphatic and aromatic alcohols having molecular weights of from about 90 to about 240; aliphatic ketones having molecular weights of from about 150 to about 260; aromatic ketones having molecular weights of from about 150 to about 270; aromatic and aliphatic lactones having molecular weights of from about 130 to about 290; aliphatic aldehydes having molecular weights of from about 140 to about 230; aromatic aldehydes having molecular weights of from about 90 to about 230; aliphatic and aromatic ethers having molecular weights of from about 150 to about 270; and condensation products of aldehydes and amines having molecular weights of from about 180 to about 320; okoumal; indole, and mixtures thereof and being essentially free from nitromusks and halogenated fragrance materials.

Common fragrance materials that are especially avoided include: olibanum resinoid; labdanum clair; benzoin resinoid; peru balsam; methyl heptyl ketone; and methyl nonyl ketone. These materials tend to make the objectionable note even more objectionable. Such materials are kept at a level that is less than about 25%, preferably less than about 5%, and more preferably such materials are essentially eliminated from the perfume compositions.

It is desirable that, at least about 25%, preferably at least about 50%, more preferably at least about 75%, by weight of the perfume is composed of fragrance material selected from the group consisting of:

| Common Name | Chemical Type | Chemical Name | Approx. M.W. |
|---|---|---|---|
| adoxal | aliphatic aldehyde | 2,6,10-trimethyl-9-undecen-1-al | 210 |
| allyl amyl glycolate | ester | allyl amyl glycolate | 182 |
| allyl cyclohexane propionate | ester | allyl-3-cyclohexyl propionate | 196 |
| wnyl acetate | ester | 3-methyl-1-butanol acetate | 130 |
| amyl salicylate | ester | amyl salicylate | 208 |
| anisic aldehyde | aromatic aldehyde | 4-methoxy benzaidehyde | 136 |
| aurantiol | schiffbase | condensation product of methyl anthranilate and hydroxycitronellal | 305 |
| bacdanol | aliphatic alcohol | 2-ethyl-4-(2,2,3-trimethyl-3-cyclopenten-1-yl)-2-buten-1-ol | 208 |
| benzaldehyde | aromatic aldehyde | benzaldehyde | 106 |
| benzophenone | aromatic ketone | benzophenone | 182 |
| benzyl acetate | ester | benzyl acetate | 150 |
| benzyl salicylate | ester | benzyl salicylate | 228 |
| beta damascone | aliphatic ketone | 1-(2,6,6-trimethyl-1-cyclo-hexen-1-yl)-2-buten-1-one | 192 |
| beta gamma hexanol | alcohol | 3-hexen-1-ol | 100 |
| buccoxime | aliphatic ketone | 1,5-dimethyl-oxime bicyclo[3,2,1]octan-8-one | 167 |
| cedrol | alcohol | octahydro-3,6,8,9-tetramethyl-1H-3A,7-methanoazulen-6-ol | 222 |
| cetalox | ether | dodecahydro-3A,6,6,9A-tetrarnethylnaphtho[2,1B]-furan | 236 |
| cis-3-hexenyl acetate | ester | cis-3-hexenyl acetate | 142 |
| cis-3-hexenyl salicylate | ester | beta, gamma-hexenyl salicylate | 220 |
| citronellol | alcohol | 3,7-dimethyl-6-menol | 156 |
| citronellyl nitrite | nitrile | geranyl nitrile | 151 |
| clove stem oil | natural | | |
| coumarin | lactone | coumarin | 146 |
| cyclohexyl salicylate | ester | cyclohexyl salicylate | 220 |
| cymal | aromatic aldehyde | 2-methyl-3-(para iso propyl phenyl)propionaidehyde | 190 |
| decyl aldehyde | aliphatic aldehyde | decyl aldehyde | 156 |
| delta damascone | aliphatic ketone | 1-(2,6,6-trimethyl-3-cyclo-hexen-1-yl)-2-buten-1-one | 192 |
| dihydromyrcenol | alcohol | 3-methylene-7-methyl octan-7-ol | 156 |
| dimethyl benzyl carbinyl acetate | ester | dimethyl benzyl carbinyl acetate | 192 |
| ethyl vanillin | aromatic aldehyde | ethyl vanillin | 166 |
| ethyl-2-methyl butyrate | ester | ethyl-2-methyl butyrate | 130 |
| ethylene brassylate | macrocyclic lactone | ethylene tridecan-1,13-dioate | 270 |
| eucalyptol | aliphatic epoxide | 1,8-epoxy-para-menthane | 154 |
| eugenol | alcohol | 4-allyl-2-methoxy phenol | 164 |
| exaltolide | macrocyclic lactone | cyclopentadecanolide | 240 |
| flor acetate | ester | dihydro-nor-cyclopentadienyl acetate | 190 |
| florhydral | aromatic aldehyde | 3-(3-isopropylphenyl) butanal | 190 |
| frutene | ester | dihydro-nor-cyclopentadienyl propionate | 206 |
| galaxolide | ether | 1,3,4,6,7,8-hexahydro-4,6,6,7,8,8-hexamethylcyclopenta-gamma-2-benzopyrane | 258 |
| gamma decalactone | lactone | 4-N-hepty-4-hydroxybutanoic acid lactone | 170 |
| gamma dodecalactone | lactone | 4-N-octyl-4-hydroxy-butanoic acid lactone | 198 |
| geraniol | alcohol | 3,7-dimethyl-2,6-octadien-1-ol | 154 |
| geranyl acetate | ester | 3,7-dimethyl-2,6-octadien-1-yl acetate | 196 |
| geranyl nitrile | ester | 3,7-dimethyl-2,6-octadienenitrile | 149 |
| helional | aromatic aldehyde | alpha-methyl-3,4,(methylenedioxy) hydrocinnamaldehyde | 192 |

-continued

| Common Name | Chemical Type | Chemical Name | Approx. M.W. |
|---|---|---|---|
| heliotropin | aromatic aldehyde | heliotropin | 150 |
| hexyl | ester | hexyl acteate | 144 |
| hexyl cinnamic aldehyde | aromatic aldehyde | alpha-n-hexyl cinnamic aldehyde | 216 |
| hexyl salicylate | ester | hexyl salicylate | 222 |
| hydroxyambran | aliphatic alcohol | 2-cyclododecyl-propanol | 226 |
| hydroxycitronellal | aliphatic aldehdye | hydroxycitronellal | 172 |
| indole | aromatic amine | 2,3-benzopyrrole | 117 |
| ionone alpha | aliphatic ketone | 4-(2,6,6-trimethyl-1-cyclohexenyl-1-yl)-3-buten-2-one | 192 |
| ionone beta | aliphatic ketone | 4-(2,6,6-trimethyl-1-cyclohexen-1-yl)-3-butene-2-one | 192 |
| ionone gamma methyl | aliphatic ketone | 4-(2,6,6-trimethyl-2-cyclohexyl-1-yl)-3-methyl-3-buten-2-one | 206 |
| iso E super | aliphatic ketone | 7-acetyl-1,2,3,4,5,6,7,8-octahydro-1,1,6,7,tetramethyl naphthalene | 234 |
| iso eugenol | ether | 2-methoxy4-(1-propenyl) phenol | 164 |
| iso jasmone | aliphatic ketone | 2-methyl-3-(2-pentenyl)-2-cyclopenten-1-one | 166 |
| koavone | aliphatic aldehyde | acetyl di-isoamylene | 182 |
| lauric aldehyde | aliphatic aldehyde | lauric aldehyde | 184 |
| lavandin | natural | | |
| lavender | natural | | |
| lemon CP | natural | major component d-limonene | |
| d-limonene/orange terpenes | alkene | 1-methyl-4-iso-propenyl-1-cyclohexene | 136 |
| linalool | alcohol | 3-hydroxy-3,7-dimethyl-1,6-octadiene | 154 |
| linalyl acetate | ester | 3-hydroxy-3,7-dimethyl-1,6-octadiene acetate | 196 |
| lrg 201 | ester | 2,4-dihydroxy-3,6-dimethyl benzoic acid methyl ester | 196 |
| lyral | aliphatic aldehyde | 4-(4-hydroxy-4-methyl-pentyl) 3-cylcohexene-1-carboxaldehyde | 210 |
| majantol | aliphatic alcohol | 2,2-dimethyl-3-(3-methylphenyl)-propanol | 179 |
| mayol | alcohol | 4-(1-methylethyl) cyclohexane medianol | 156 |
| methyl anthranilate | aromatic amine | methyl-2-aminobenzoate | 151 |
| methyl beta naphthyl ketone | aromatic ketone | methyl beta naphthyl ketone | 170 |
| methyl cedrylone | aliphatic ketone | methyl cedrenyl ketone | 246 |
| methyl chavicol | ester | 1-methyloxy-4,2-propen-1-yl benzene | 148 |
| methyl dihydro jasmonate | aliphatic ketone | methyl dihydro jasmonate | 226 |
| methyl nonyl acetaldehyde | aliphatic aldehyde | methyl nonyl acetaldehyde | 184 |
| musk indanone | aromatic ketone | 4-acetyl-6-tert butyl-1,1-dimethyl indane | 244 |
| nerol | alcohol | 2-cis-3,7-dimethyl-2,6-octadien-1-ol | 154 |
| nonalactone | lactone | 4-hydroxynonanoic acid, lactone | 156 |
| norlimbanol | aliphatic alcohol | 1-(2,2,6-trimethyl-cyclohexyl)-3-hexanol | 226 |
| okoumal | aromatic aldehyde | 1,3-dioxolane-2,4-dimethyl-2-(5,6,7,8-tetrahydro-5,5,8,8-tetramethyl-2-naphthalenyl)-cis-ketal | 288 |
| orange CP | natural | major component d-limonene | |
| P. T. bucinal | aromatic aldehyde | 2-methyl-3(para tert butylphenyl) propionaldehyde | 204 |
| para hydroxy phenyl butanone | aromatic ketone | para hydroxy phenyl butanone | 164 |
| patchouli | natural | | |
| phenyl acetaldehyde | aromatic aldehyde | 1-oxo-2-phenylethane | 120 |
| phenyl acetaidehyde dimethyl acetal | aromatic aldehyde | phenyl acetaldehyde dimethyl acetal | 166 |
| phenyl ethyl acetate | ester | phenyl ethyl acetate | 164 |
| | alcohol | phenyl ethyl alcohol | 122 |
| phenyl ethyl phenyl acetate | ester | 2-phenylethyl phenyl acetate | 240 |

-continued

| Common Name | Chemical Type | Chemical Name | Approx. M.W. |
|---|---|---|---|
| phenylhexanol/phenoxanol | alcohol | 3-methyl-5-phenylpentanol | 178 |
| polysantol | aliphatic alcohol | 3,3-dimethyl-5-(2,2,3-trimethyl-3-cyclopenten-1-yl)4-penten-2-ol | 221 |
| prenyl acetate | ester | 2-methylbuten-2-ol-4-acetate | 128 |
| rosaphen | aromatic alcohol | 2-methyl-5-phenyl pentanol | 178 |
| sandalwood | natural | | |
| alpha-terpinene | aliphatic alkane | 1-methyl-4-iso-propylcyclohexadiene-1,3 | 136 |
| terpineol (alpha terpineol and beta terpineol) | alcohol | para-menth-1-en-g-ol, para-menth-1-en-1-ol | 154 |
| terpinyl acetate | ester | para-menth-1-en-8-yl acetate | 196 |
| tetra hydro linalool | aliphtic alcohol | 3,7-dimethyl-octanol | 158 |
| tetrahydromyrcenol | aliphatic alcohol | 2,6-dimethyl-ocatanol | 158 |
| tonalid/musk plus | aromatic ketone | 7-acetyl-1,1,3,4,4,6-hexamethyl tetralin | 258 |
| undecalactone | lactone | 4-N-heptyl-4-hydroxybutanoic acid lactone | 184 |
| undecavertol | alcohol | 4-methyl-3-decen-5-ol | 170 |
| undecyl aldehyde | aliphatic aldehyde | undecanal | 170 |
| undecylenic aldehyde | aliphatic aldehyde | undecylenic aldehyde | 168 |
| vanillin | aromatic aldehyde | 4-hydroxy-3-methoxybenzaldehyde | 152 |
| verdox | ester | 2-tert-butyl cyclohexyl acetate | 198 |
| vertenex | ester | 4-tertiary-butyl cyclohexyl acetate | |

and mixtures thereof.

Optional Ingredients

Fully formulated fabric softening compositions preferably contain, in addition to the hereinbefore described components, one or more of the following ingredients:

Optional Free Radical Scavenging Antioxidant Materials and Chelants:

The cellulase herein is preferably stabilized by one, or more, free radical scavenging antioxidant materials and/or chelants. The term "antioxidant effective amount", as used herein, means an amount of a free radical scavenging antioxidant material, chelant, or mixtures thereof, effective for increasing the storage stability of the cellulase in the fabric-conditioning compositions. Levels of free radical scavenging antioxidant materials and chelants to be used in products are therefore easily determined, and are illustrated further hereinafter.

1. Free Radical Scavenging Antioxidant Materials:

"Free radical scavenging antioxidant materials", as used herein, means those materials which act to prevent oxidation in products by functioning as free radical scavengers. Examples of such antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; and Irganox® antioxidants (supplied by Ciba-Geigy), such as Irganox® 1010 [tetrakis (methylene (3,5-di-tert-butyl-4-hydroxyhydrocinnamate)) methane]; Irganox® 1035 [thiodiethylene bis(3,5-di-tert-butyl-4-hydroxyhydrocinnamate)]; Irganox® 1425 [calcium bis(monoethyl(3,5-di-tert-butyl-4-hydroxybenzyl) phosphonate)]; Irganox® 3114 [1,3,5-tris(3,5-di-tert-butyl-4-hydroxybenzyl)-S-triazine-2,4,6-(1H, 3H, 5H)trione]; Irganox® 3125 [3,5-di-tert-butyl-4-hydroxy-hydrocinnamic acid triester with 1,3,5-tris(2-hydroxyethyl)-S-triazine-2,4,6-(1H, 3H, 5H)-trione]; Irganox® 1098 [N,N'-hexamethylene bis(3,5-di-tert-butyl-4-hydroxyhydro-cinnamamide)]; and mixtures thereof.

Preferred are BHT, BHA, TBHQ, propyl gallate, and especially Irganox-3125, which has the chemical structure:

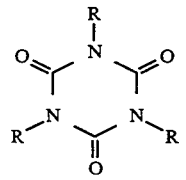

wherein R is

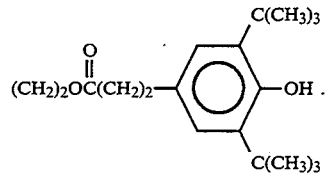

It is to be recognized that for purposes of the present invention, materials otherwise useful as antioxidants which do not act as free radical scavengers, such as those materials which function solely by chelating metals which can initiate oxidation reactions, are not "free radical scavenging antioxidant materials" herein but are chelants as described hereinafter. Free radical scavenging antioxidant materials are typically present in the compositions according to the present invention within the range of from about 10 ppm to about 0.5%, preferably from about 100 ppm to about 2,000 ppm, and most preferably from about 150 ppm to about 1000 ppm.

2. Chelants

The present invention compositions can also comprise chelants (which as used herein also includes materials effective not only for binding metals in solution but also those effective for precipitating metals from solution) alone or in combination with the free radical scavenging antioxidant materials. Preferred chelants for use herein include citric acid, citrate salts (e.g., trisodium citrate), isopropyl citrate, Dequest® 2010 [available from Monsanto with a chemical name of 1-hydroxyethylidene-1,1-diphosphonic acid (etidronic acid)], Tiron® (available from Kodak with a chemical name of 4,5-dihydroxy-m-benzene-sulfonic acid/sodium salt), DTPAR (available from Aldrich with a chemical name of diethylenetriaminepentaacetic acid), ethylene diaminetetraacetic acid (EDTA), ethylene diamine-N, N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred are EDTA and especially citric acid and titrate salts.

Compositions according to the present invention preferably comprise a chelant in an amount of from about 10 ppm to about 0.5%, preferably from about 25 ppm to about 1000 ppm, by weight of the composition.

Compositions according to the present invention can also comprise polymer having a partial or net cationic charge to further increase the cellulase stability in the compositions herein. Such polymers can be used at levels of from 0.001% to 10%, preferably 0.01% to 2% by weight of the compositions.

Such polymers having a partial cationic charge can be polyamine N-oxide containing polymers which, e.g., contain monomeric units having the following structure formula:

$$-[R-A_x-P]-$$

wherein: each P is a polymerisable unit; each A is —NC(O)—, —C(O)O—, C(O)—, —O—, —S—, —N—; each x is 0 or 1; each R is aliphatic, ethoxylated aliphatic, aromatic, heterocyclic or alicyclic group (the R—N→O group can either be attached to (i.e., be pendant on), or form part of, either P, R, or both or be a combination of any of these options).

The N→O group can be represented by the following general structures:

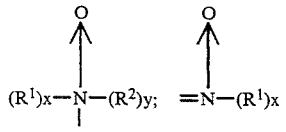

wherein $R^1$, $R^2$, and $R^3$ are aliphatic, aromatic, heterocyclic or alicyclic groups or combinations thereof, x and/or y and/or z is 0 or 1 and wherein the nitrogen of the N→O group can be attached to P and/or R, or wherein the nitrogen of the N→O group forms part of these groups.

The N→O group can be part of the polymerisable unit (P), or can be attached to the polymeric backbone, or a combination of both.

Suitable polyamine N-oxides wherein the N→O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N→O group forms part of the R-group. Preferred polyamine N-oxides are those wherein R is a heterocyclic group derived from compounds such as pyridine, pyrrole, imidazole, pyrrolidine, piperidine, quinoline, acridine and/or derivatives of such compounds.

Another class of said polyamine N-oxides comprises the group of polyamine N-oxides wherein the nitrogen of the N→O group is attached to the R-group.

Other suitable polyamine N-oxides are the polyamine oxides wherein the N→O group is attached to the polymerisable unit.

A preferred class of these polyamine N-oxides are the polyamine N-oxides having the general formula (wherein each R is an aromatic, heterocyclic or alicyclic groups wherein the nitrogen of the N→O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula wherein each R is an aromatic, heterocyclic or alicyclic group wherein the nitrogen of the N→O functional group is attached to said R group.

Examples of these classes are polyamine oxides wherein R groups can be aromatic such as phenyl.

Any polymer backbone can be used as long as the amine oxide polymer formed is water-soluble and has stabilizing properties. Examples of suitable polymeric backbones are polyvinyls, polyalkylenes, polyesters, polyethers, polyamide, polyimides, polyacrylates and mixtures thereof. These polymers can also provide dye transfer inhibition properties.

The amine N-oxide polymers useful herein typically have a ratio of amine group to the amine N-oxide group of about 10:1 to about 1:1000000. However the amount of amine oxide groups present in the polyamine N-oxide containing polymer can be varied by appropriate copolymerization or by appropriate degree of N-oxidation. Preferably, the ratio of amine to amine N-oxide is from about 2:3 to about 1:1000000. More preferably from about 1:4 to about 1:1000000, most preferably from about 1:7 to about 1:1000000. The polymers of the present invention actually encompass random or block copolymers where one monomer type is an amine N-oxide and the other monomer type is either an amine N-oxide or not. The amine oxide unit of the polyamine N-oxides has a PKa $<10$, preferably PKa $<7$, more preferred PKa $<6$.

The polyamine N-oxide containing polymer can be obtained in almost any degree of polymerization. The degree of polymerization is not critical provided the material has the desired water-solubility and solubilizing power.

Typically, the average molecular weight of the polyamine N-oxide containing polymer is within the range of about 500 to about 1000,000; preferably from about 1,000 to about 50,000, more preferably from about 2,000 to about 30,000, most preferably from about 3,000 to about 20,000.

Other polymers having a net cationic charge include polyvinylpyrrolidone (PVP) as well as copolymers of N-vinylimidazole N-vinyl pyrrolidone, having an average molecular weight range in the range about 5,000 to about 100,000, preferably about 5,000 to about 50,000; said copolymers having a molar ratio of N-vinylimidazole to N-vinylpyrrolidone from about 1 to about 0.2, preferably from about 0.8 to about 0.3.

Surfactant/Concentration Aids

Although as stated before, relatively concentrated compositions of the unsaturated fabric softener material of Formula (I) and (II) above can be prepared that are stable without the addition of concentration aids, the concentrated compositions of the present invention may require organic and/or inorganic concentration aids to go to even higher concentrations and/or to meet higher stability standards depending on the other ingredients.

Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Such mono-long-chain-alkyl cationic surfactants useful in the present invention are, preferably, quaternary ammonium salts of the general formula:

$$[R^2N^+R^3]\ X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

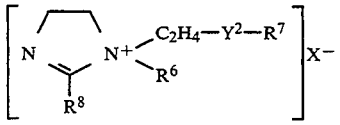

wherein $y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

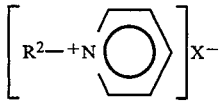

wherein $R^2$ and X- are as defined above for the single long chain cationic surfactants. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from about 7 to about 20, preferably from about 8 to about 15. Examples of particularly suitable nonionic surfactants include Straight-chain, primary alcohol alkoxylates such as tallow alcohol-EO(11), tallow alcohol-EO(18), and tallow alcohol-EO(25), i.e., tallow alcohol ethoxylated with 11, 18, and 25 moles of ethylene oxide respectively;

Straight-chain, secondary alcohol alkoxylates such as 2-$C_{16}$EO(11); 2-$C_{20}$EO(11); and 2- $C_{16}$EO(14);

Alkyl phenol alkoxylates, such as p-tridecylphenol EO(11) and p-pentadecylphenol EO(18), as well as Olefinic alkoxylates, and branched chain alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from the group consisting of alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 10 to 14 (mid cut), carbon atoms. The shorter moiety contains from 1 to 4, preferably from 1 to 2 carbon atoms.

Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents can stabilize the viscosity over a broader range of temperature, especially at low temperatures, as compared to the inorganic electrolytes.

Specific examples of alkylene polyammonium salts include 1-lysine monohydrochloride and 1,5-diammonium 2-methyl pentane dihydrochloride.

Liquid Carrier

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200 molecular weight, organic solvent, e.g., lower alcohol such as ethanol, propanol, isopropanol or butanol are useful as the carder liquid. Low molecular weight alcohols include monohydric, dihydric (glycol, etc.) trihydric (glycerol, etc.), and higher polyhydric (polyols) alcohols.

Still other optional ingredients are soil release polymers, bacteriocides, colorants, perfumes, preservatives, optical brighteners, anti ionization agents, antifoam agents, and the like.

In the specification and in the Examples herein, all percentages, ratios, and parts are by weight and are approximations, unless otherwise specified.

In the following Examples, the perfumes have the following compositions.

Perfumes A–C

| Perfume Material | A Wt. % | B Wt. % | C Wt. % |
|---|---|---|---|
| 3,7-Dimethyl-6-octenol | 10 | — | 5 |
| Benzyl salicylate | 5 | 20 | 5 |
| Benzyl acetate | 10 | 15 | 5 |
| Benzophenone | 3 | 5 | — |
| Octahydro-3,6,8,8-tetramethyl-1H-3A,7-methanoazulen-6-ol | 2 | — | — |
| 3-Methylene-7-methyl octan-7-ol | 10 | — | 5 |
| Dihydro-nor-cyclopentadienyl acetate | 5 | — | 5 |
| 1,3,4,6,7,8-Hexahydro-4,6,6,7,8,8-hexamethylcyclopenta-gamma-2-benzopyrane | 10 | — | — |
| Phenyl ethyl alcohol | 15 | 10 | 20 |
| 3-Hydroxy-3,7-dimethyl-1,6-octadiene acetate | 4 | — | 5 |
| 3-Hydroxy-3,7-dimethyl-1,6-octadiene | 6 | 15 | 5 |
| Methyl dihydro jasmonate | 3 | 10 | 5 |
| 2-Methyl-3(para tert butylphenyl) propionaldehyde | 10 | 15 | 20 |
| Phenyl ethyl acetate | 2 | 5 | 1 |
| 4-Hydroxy-3-methoxybenzaldehyde | — | — | 1 |
| para-Menth-1-en-8-ol, para-menth-1-en-1-ol | 5 | — | 8 |
| Anisic aldehyde | — | — | 2 |
| Coumarin | — | — | 5 |
| 2-Methyl-3-(para iso propylphenyl) propionaldehyde | — | — | 3 |
| Total | 100 | 100 | 100 |

Perfumes D–F

| | D | E | F |
|---|---|---|---|
| Orange terpenes | 20 | 15 | 10 |
| Methyl dihydro jasmonate | 15 | 1 | 10 |
| Lyral | 5 | — | — |
| Tonalid | 20 | — | — |
| Linalool | 5 | 3 | — |
| P.T. bucinal | 5 | 10 | 20 |
| Geraniol | 5 | 2 | — |
| Dihydromyrcenol | 10 | 5 | 5 |
| Musk indanone | 5 | — | — |
| Verdox | 1 | — | — |
| Vanillin | 1 | — | — |
| Hexyl cinnamic aldehyde | 5 | 10 | 20 |
| Fructone | 0.5 | — | — |
| Frutene | 1 | 2 | — |
| Floracetate | 1.5 | 4 | — |
| Ionone beta | — | — | 1 |
| Anisic aldehyde | — | — | 1 |
| Amyl salicylate | — | — | 2 |
| Coumarin | — | 1 | — |
| Hexyl salicylate | — | — | 2 |
| Phenylethyl alcohol | — | 5 | 10 |
| Terpineol (alpha) | — | 3 | 10 |
| Benzyl salicylate | — | 2 | — |
| Benzyl acetate | — | 10 | 10 |
| Ionone gamma methyl | — | 4 | — |
| Iso E super | — | 5 | — |
| Patchouli | — | 2 | — |
| Undecalactone | — | 1 | 1 |
| Galaxolide | — | 5 | — |
| TOTAL | 100 | 100 | 100 |

Perfume G

| Perfume Material | Wt. % |
|---|---|
| Allyl cyclohexane propionate | 2 |
| Amyl salicylate | 2 |
| Benzyl salicylate | 2 |
| Benzyl acetate | 5 |
| Citronellol | 5 |
| Dihydromurcenol | 8 |
| Dimethyl benzyl carbinyl acetate | 1 |
| Eugenol | 2 |
| Frutene | 7 |
| Glaxolide | 6 |
| Geraniol | 2 |
| Hexyl cinnamic aldehyde | 9 |
| Iso E super | 3 |
| Linalool | 5 |
| Methyl dihydro jasmonate | 4 |

-continued

| | |
|---|---|
| alpha-Methyl ionone | 2 |
| gamma-Methyl ionone | 6 |
| P. T. bucinal | 5 |
| Tetrahydrolinalool | 10 |
| Tonalid | 3 |
| Verdox | 1 |
| Vertenex | 10 |
| Total | 100 |

Comparative Perfume H

| Perfume Material | Wt. % |
|---|---|
| Olibanum resinoid 80% | 35 |
| Labdanum Clair | 25 |
| Benzoin resinoid 80% in DEP | 10 |
| Peru balsam | 5.5 |
| Methyl heptyl ketone | 4.5 |
| Methyl nonyl ketone | 15 |
| Dipropylene glycol | 5 |
| Total | 100 |

EXAMPLES

| Components | I Wt. % | II Wt. % |
|---|---|---|
| Ester Quat Compound(1) | 9.46 | — |
| Ester Quat Compound(2) | — | 10.1 |
| Isopropyl Alcohol | 0.38 | — |
| HCl (25%) | 0.06 | 0.06 |
| Cellulase(3) | 0.5 | 0.4 |
| DC-2210 Antifoam | — | — |
| $CaCl_2$ (25%) | 0.06 | 0.06 |
| Kathon CG (1.5%) | — | — |
| Perfume A | 0.5 | — |
| Perfume B | — | 0.45 |
| Deionized Water | Balance to 100% | Balance to 100% |

(1)Di(hardened tallowoyloxyethyl) dimethyl ammonium chloride.
(2)Di(soft tallowoyloxyethyl) dimethyl ammonium chloride wherein the fatty acyl groups are derived from fatty acids with an IV of about 55, % unsaturation of about 53.1, and C18 cis/trans isomer ratio of about 8.2 (cis isomer about 40% and trans isomer about 4.9%); the diester includes monoester at a weight ratio of about 11:1 diester to monoester; 96% solids in isopropanl.
(3)The cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase; the cellulase solution used provides about 5,000 CEVU's per gram.

EXAMPLE I—PROCESS

About 0.6 g of a HCl solution (25%) is added to about 890 g deionized water preheated to about 66° C. in a stainless steel mixing tank to form a water seat. The water seat is mixed with an IKA mixer (Model RW 20 DZM ®) at about 1500 rpm using an impeller with about 5.1 cm diameter blades. A mixture of about 94.6 g of a di(hardened tallowoyoxyethyl) dimethyl ammonium chloride and about 4 g of isopropyl alcohol, preheated to about 89° C., is then slowly added to the water seat via a gravity-fed drop funnel so that the premix is injected near the mixer impeller. Hydrochloric acid is added to reduce the pH of the mix to about 2.5. About 0.6 g of a 25% $CaCl_2$ solution is added and the mixture is milled, using an IKA Ultra Turrax T-50 ® high shear mixer (at about 10,000 rpm). The batch is cooled to about 21°-27° C., then about 5 g of Perfume A and about 5 g of cellulase solution is added to the mixture with mixing.

EXAMPLE II—PROCESS

The making process of Example II is similar to that of Example I, except that about 101 g of the Ester quaternary ammonium compound, containing about 86% di(-soft tallowoyoxyethyl) dimethyl ammonium chloride in ethanol, preheated to about 66° C. is used, instead of the di(hardened tallowoyoxyethyl) dimethyl ammonium chloride and isopropyl alcohol mixture.

| Components | IIII Wt. % | IV Wt. % |
|---|---|---|
| Hydroxyethyl Ester Quat (1) | 9.8 | 9.8 |
| HCl (25%) | 0.05 | 0.05 |
| Cellulase(2) | 0.3 | 0.3 |
| $CaCl_2$ (25%) | 0.06 | 0.06 |
| Blue Dye (1%) | 0.08 | 0.08 |
| Kathon CG (1.5%) | 0.02 | 0.02 |
| Perfume D | 0.4 | — |
| Perfume E | — | 0.4 |
| Deionized Water | Balance to 100% | Balance to 100% |

(1)Di(tallowoyloxyethyl)(2-hydroxyethyl)methyl ammonium methyl sulfate, 85% active in ethanol.
(2)The cellulase of Example I.

EXAMPLES III AND IV PROCESS

About 0.5 g of a HCl solution (25%) is added to about 892 g deionized water preheated to about 70° C. in a 1.5 L stainless steel mix tank. This "water seat" is mixed with an IKA mixer (Model RW 25 ®) at about 1000 rpm using an impeller with about 5.1 cm diameter blades. About 98 g of Stepanquat 6585-ET containing about 85% hydroxyethyl ester quat in ethanol, preheated to about 70° C., is then slowly added to the water seat, by injection at the impeller blades via a peristaltic pump. The mixture is cooled during mixing, and about 4.5 g Perfume B, about 0.2 g of a 1.5% Kathon solution, about 0.8 g of a dye solution, and about 3 g cellulase solution are added when the mixture temperature reaches about 27° C. About 0.6 g of a 25% $CaCl_2$ solution is added with mixing.

| Components | V Wt. % | VI Wt. % |
|---|---|---|
| Propyl Ester Quat (1) | 8.67 | 8.67 |
| Ethanol | 1.2 | 1.2 |
| HCl (25%) | 0.06 | 0.06 |
| Cellulase(2) | 0.4 | 0.4 |
| $CaCl_2$ (25%) | 0.06 | 0.06 |
| Kathon CG (1.5%) | 0.02 | 0.02 |
| Perfume F | 0.45 | — |
| Perfume G | — | 0.45 |
| Deionized Water | Balance to 100% | Balance to 100% |

(1)1,2-Di(hardened tallowoyloxy)-3-trimethyl ammoniopropane chloride.
(2)The cellulase of Example I.

EXAMPLES V AND VI PROCESS

The making procedures of Examples V and VI are similar to that of Example III, except that a mixture of about 86.7 g of the propyl ester quat and about 12 g of ethanol, pre-heated to about 82° C. is used, instead of the hydroxyethyl ester quat in ethanol mixture.

| Components | VII Wt. % | VIII Wt. % |
|---|---|---|
| Ester Quat Compound(1) | 30.6 | 30.6 |
| HCl (25%) | 0.018 | 0.018 |
| Cellulase(2) | 1.2 | 1.2 |
| DC-2210 Antifoam | 0.25 | 0.25 |
| $CaCl_2$ (25%) | 2.0 | 2.0 |
| Liquitint Blue 651 Dye (1%) | 0.27 | 0.27 |
| Tenox 6 | 0.035 | 0.035 |
| Kathon CG (1.5%) | 0.02 | 0.02 |

-continued

| Components | VII Wt. % | VIII Wt. % |
|---|---|---|
| Perfume A | 1.35 | — |
| Perfume B | — | 1.35 |
| Deionized Water | Balance to 100% | Balance to 100% |

(1)Di(soft tallowoyloxyethyl) dimethyl ammonium chloride of Example II.
(2)The cellulase of Example I.

EXAMPLES VII AND VIII PROCESS

The water seat containing deionized water, HCl and antifoam agent is heated to about 74° C. A diester quaternary ammonium compound premix with the Tenox 6, pre-heated to about 74° C., is added to the water seat. During the injection, both mix (about 600–1,000 rpm) and mill (about 8,000 rpm with an IKA Ultra Turrax T-50 Mill) the batch. About 500 ppm of $CaCl_2$ is added at approximately halfway through the injection and about 2,000 ppm more of $CaCl_2$ is added slowly after the premix injection is complete. The batch is cooled to about 21°–27° C. Perfume A or B, dye, Kathon, and cellulase, are added with mixing. Finally, about 2,500 ppm to about 4,000 ppm $CaCl_2$ is added to the cooled batch with mixing.

| Components | IX Wt. % | Comparable Example X Wt. % |
|---|---|---|
| Ester Quat Compound(1) | 30.6 | 30.6 |
| HCl (25%) | 0.018 | 0.018 |
| Cellulase(2) | 1.2 | 1.2 |
| DC-2210 Antifoam | 0.25 | 0.25 |
| $CaCl_2$ (25%) | 2.0 | 2.0 |
| Liquitint Blue 651 Dye (1%) | 0.27 | 0.27 |
| Tenox 6 | 0.035 | 0.035 |
| Kathon CG (1.5%) | 0.02 | 0.02 |
| Perfume C | 1.35 | — |
| Comparative Perfume H | — | 1.35 |
| Deionized Water | Balance to 100% | Balance to 100% |

(1)Di(soft tallowoyloxyethyl) dimethyl ammonium chloride of Example II.
(2)The cellulase of Example I.

EXAMPLE IX AND COMPARATIVE EXAMPLE X PROCESS

The processes of Examples IX and X are similar to that of Example VII.

The compositions of Examples I to IX are used in a typical U.S. machine washing process to clean fabrics by addition of an effective amount of the composition to the rinse cycle of this process which used about 60 liters to about 80 liters of water for the rinse solution, to provide cleaned fabrics having noticeable fabric benefits. Typically, from about 60 to about 90 g of the composition of Examples I to VI is added to the rinse cycle. The concentrated compositions of Examples VII to IX are added to about 30 g to 40 g to the rinse water.

About 30 g of the base composition of Example VII (not containing perfume) is used to soften fabrics in a rinse cycle using about 64 liters of water. This process provides about 28 CEVU's of cellulase per liter of rinse solution. The odor of the fabrics is considered not acceptable to a panel of trained experts. When Compositions VII, VIII, or IX containing Perfume A, B, or C is used in an identical rinse cycle, the odor is considered desirable by the same panel. When the base formula with Comparative Perfume H (Comparative Example X) is used in an identical rinse cycle, the odor is considered even more objectionable by the same panel.

What is claimed is:

1. A fabric conditioning composition for the treatment of fabrics comprising:
   (a) from about 1% to about 90% of one or more cationic fabric softening agents, nonionic fabric softening agents, or mixtures thereof;
   (b) from about 0.1 to about 125 CEVU/gram of cellulase; and
   (c) an effective amount of perfume material selected to cover off-odor associated with said treatment of fabrics with said composition comprising components (a) and (b).

2. The composition according to claim 1 wherein the cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase.

3. The composition according to claim 2 comprising from about 2% to about 50% by weight of one or more fabric softening agents.

4. The composition according to claim 1 comprising from about 2% to about 50% by weight of one or more fabric softening agents.

5. The composition according to claim 1 wherein said cationic fabric softening agents comprise quaternary ammonium softening agent or amine precursor thereof of the formula:

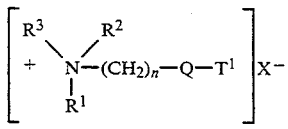

(I)

or

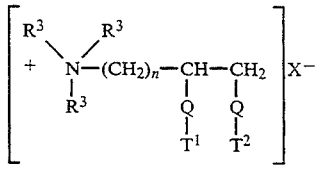

(II)

Q is—O—C(O)— or —C(O)—O— or —O—C(O)—O— or —$NR^4$—C(O)— or —C(O)—$NR^4$—;
$R^1$ is $(CH_2)_n$—Q—$T^2$ or $T^3$;
$R^2$ is $(CH_2)_m$—Q—$T^4$ or $T^5$ or $R^3$;
$R^3$ is $C_1$–$C_4$ alkyl or $C_1$–$C_4$ hydroxyalkyl or H;
$R^4$ is H or $C_1$–$C_4$ alkyl or $C_1$–$C_4$ hydroxyalkyl;
each $T^1$, $T^2$, $T^3$, $T^4$, and $T^5$ is $C_{11-C22}$ alkyl or alkenyl;
n and m are integers from 1 to 4; and
$X^-$ is a softener-compatible anion,
and wherein the composition has a pH measured on the composition itself, at 20° C., of from about 2.0 to about 4.5.

6. The composition according to claim 5 comprising from about 2% to about 50% by weight of the fabric softening agents.

7. The composition according to claim 5 wherein the quaternary ammonium softening agent is N,N-di(2-tallowoyl-oxy-ethyl)-N,N-dimethyl ammonium chloride.

8. The composition according to claim 1 further comprising free radical scavenging antioxidant material selected from the group consisting of ascorbic acid, ascorbic palmitate, propyl gallate, butylated hydroxytoluene, butylated hydroxyanisole, tertiary butylhydroquinone, natural tocopherols, $C_8$–$C_{22}$ esters of gallic acid, tetrakis(methylene(3,5-di-tert-butyl-4-hydroxyhydrocinnamate)) methane; thiodiethylene bis (3,5-di-tert-butyl-4-hydroxyhydrocinnamate); calcium bis(monoethyl(3,5-di-tert-butyl-4-hydroxybenzyl) phosphonate); 1,3,5-tris(3,5-di-tert-butyl-4-hydroxybenzyl)-s-triazine-2,4,6-(1H, 3H, 5H)trione; 3,5-di-tert-butyl-4-hydroxyhydrocinnamic acid triester with 1,3,5-tris(2-hydroxyethyl)-S-triazine-2,4,6(1H, 3H, 5H)-trione; N,N'-hexamethylene bis(3,5-di-tert-butyl-4-hydroxyhydrocinnamamide); and mixtures thereof; and, optionally, chelant selected from the group consisting of citric acid, citrate salts, isopropyl citrate, etidronic acid, 4,5-dihydroxy-m-benzenesulfonic acid sodium salt, diethylenetriaminepentaacetic acid, ethylene diaminetetraacetic acid, ethylene diamine-N, N'-disuccinic acid, 8-hydroxyquinoline, sodium dithiocarbamate, sodium tetraphenylboron, ammonium nitrosophenyl hydroxylamine, and mixtures thereof.

9. The composition according to claim 8 wherein the free radical scavenging antioxidant material is selected from butylated hydroxytoluene, butylated hydroxyanisole, tertiary butylhydroquinone, propyl gallate, 3,5-di-tert-butyl-4-hydroxy-hydrocinnamic acid triester with 1,3,5-tris(2-hydroxyethyl)-S-triazine-2,4,6-( 1H, 3H, 5H)- trione, and mixtures thereof; and, wherein the chelant is selected from citric acid, citrate salts, ethylene diaminetetraacetic acid, and mixtures thereof.

10. The composition according to claim 9 wherein said perfume is at a level of from about 0.1% to about 5% and is selected from the group consisting of: aromatic and aliphatic esters having molecular weights of from about 120 to about 250; aliphatic and aromatic alcohols having molecular weights of from about 90 to about 240; aliphatic ketones having molecular weights of from about 150 to about 260; aromatic ketones having molecular weights of from about 150 to about 270; aromatic and aliphatic lactones having molecular weights of from about 130 to about 290; aliphatic aldehydes having molecular weights of from about 140 to about 230; aromatic aldehydes having molecular weights of from about 90 to about 230; aliphatic and aromatic ethers having molecular weights of from about 150 to about 270; and condensation products of aldehydes and amines having molecular weights of from about 180 to about 320; okoumal; indole, and mixtures thereof and being essentially free from nitromusks and halogenated fragrance materials.

11. The composition according to claim 10 wherein said perfume is at a level of from about 0.2% to about 3% and is selected from the group consisting of: 2,6,10-trimethyl-9-undecen-1-al; allyl amyl glycolate; allyl-3-cyclohexyl propionate; 3-methyl-1-butanol acetate; amyl salicylate; 4-methoxy benzaldehyde; condensation; product of methyl anthranilate and hydroxycitronellal; 2-ethyl-4-(2,2,3-trimethyl-3-cyclopenten-1-yl)-2-buten-1-ol; benzaldehyde; benzophenone; benzyl acetate; benzyl salicylate; 1-(2,6,6-trimethyl-1-cyclo-hexen-1-yl)-2-buten-1-one; 3-hexen-1-ol; 1,5-dimethyl-oxime bicyclo[3,2,1]octan-8-one; octahydro-3,6,8,8-tetramethyl-1H-3A, 7-methanoazulen-6-ol; dodecahydro-3A,6,6-,9A-tetramethylnaphtho[2,1B]-furan; cis-3-hexenyl acetate; beta, gamma-hexenyl salicylate; 3,7-dimethyl-6-octenol; geranyl nitrile; coumarin; cyclohexyl salycilate; 2-methyl-3-(para iso propyl phenyl)propionaldehyde; decyl aldehyde; 1-(2,6,6-trimethyl-3-cyclo-hexen-1-yl)-2-buten-1-one; 3-methylene-7-methyl octan-7-ol; dimethyl benzyl carbinyl acetate; ethyl vanillin; ethyl-2-methyl butyrate; ethylene tridecan-1,13-dioate; 1,8-epoxy-paramenthane; 4-allyl-2-methoxy phenol; cyclopentadecanolide; dihydro-norcyclopentadienyl acetate; 3-(3-isopropylphenyl) butanal; dihydro-norcyclopentadienyl propionate; 1,3,4,6,7,8-hexahydro-4,6,6,7,8,8-hexamethylcyclopenta-gamma-2-benzopyrane; 4-N-hepty-4-hydroxybutanoic acid lactone; 4-N-octyl-4-hydroxy-butanoic acid lactone; 3,7-dimethyl-2,6-octadien-1-ol; 3,7-dimethyl-2,6-octadien-1-yl acetate; 3,7-diemthyl-2,6-octadienenitrile; alphamethyl-3,4,(methylenedioxy)hydrocinnamaldehyde; heliotropin; hexyl acetate; alpha-n-hexyl cinnamic aldehyde; hexyl salicylate; 2-cyclododecyl-propanol; hydroxycitronellal; 2,3-benzopyrrole; 4-(2,6,6-trimethyl-1-cyclohexenyl-1-yl)-3-buten-2-one; 4-(2,6,6-trimethyl-1-cyclohexen-1-yl)-3-butene-2-one; 4-(2,6,6-trimethyl-2-cyclohexyl-1-yl)-3-methyl-3-buten-2-one; 7-acetyl-1,2,3,4,5,6,7,8-octahydro-1,1,6,7,tetramethyl naphthalene; 2-methoxy-4-(1-propenyl) phenol; 2-methyl-3-(2-pentenyl)-2-cyclopenten-1-one; acetyl di iso amylene; lauric aldehyde; lavandin; lavender; sandalwood; patchouli; lemon oil, cold pressed; 1-methyl-4-iso-propenyl-1-cyclohexene; 3-hydroxy-3,7-dimethyl-1,6-octadiene; 3-hydroxy-3,7-dimethyl-1,6-octadiene acetate; 2,4-dihydroxy-3,6-dimethyl benzoic acid methyl ester; 4-(4-hydroxy-4-methyl-pentyl) 3-cylcohexene-1-carboxaldehyde; 2,2-dimethyl-3-(3-methylphenyl)-propanol; 4-(1-methylethyl) cyclohexane methanol; methyl-2-aminobenzoate; methyl beta naphthyl ketone; methyl cedrenyl ketone; 1-methyloxy-4,2-propen-1-yl benzene; methyl dihydro jasmonate; methyl nonyl acetaldehyde; 4-acetyl-6-tert butyl-1,1-dimethyl indane; 2-cis-3,7-dimethyl-2,6-octadien-1-ol; 4-hydroxynonanoic acid, lactone; 1-(2,2,6-trimethyl-cyclohexyl)-3-hexanol; 1,3-dioxolane-2,4-dimethyl-2-(5,6,7,8-tetrahydro-5,5,8,8-tetramethyl-2-naphthalenyl)-cis-ketal; orange oil, cold pressed; 2-methyl-3(para tert butylphenyl) propionaldehyde; para hydroxy phenyl butanone; 1-oxo-2-phenylethane; phenyl acetaldehyde dimethyl acetal; phenyl ethyl acetate; phenyl ethyl alcohol; 2-phenylethyl phenyl acetate; 3-methyl-5-phenylpentanol; 3,3-dimethyl-5-(2,2,3-trimethyl-3-cyclopenten-1-yl)-4-penten-2-ol; 2-methylbuten-2-ol-4-acetate; 2-methyl-5-phenyl pentanol; 1-methyl-4-iso-propylcyclohexadiene-1,3; para-menth-1-en-8-ol, para-menth-1en-1-ol; para-menth-1-en-8-yl acetate; 3,7-dimethyl-3-octanol; 2,6-dimethyl-2-octanol; 7-acetyl-1,1,3,4,4,6-hexamethyl tetralin; 4-N-heptyl-4-hydroxybutanoic acid lactone; 4-methyl-3-decen-5-ol; undecanal; undecylenic aidehyde; 4-hydroxy-3-methoxybenzaldehyde; 2-tert-butyl cyclohexanyl acetate; 4-tertiary-butyl cyclohexyl acetate; and mixtures thereof.

12. The composition according to claim 1 wherein said perfume is at a level of from about 0.1% to about 5% and at least about 25% of said perfume is selected from the group consisting of: aromatic and aliphatic esters having molecular weights of from about 120 to about 250; aliphatic and aromatic alcohols having molecular weights of from about 90 to about 240; aliphatic ketones having molecular weights of from about 150 to about 260; aromatic ketones having molecular weights of from about 150 to about 270; aromatic and aliphatic lactones having molecular weights of from about 130 to about 290; aliphatic aldehydes having molecular weights of from about 140 to about 230; aromatic aldehydes having molecular weights of from about 90 to about 230; aliphatic and aromatic ethers having molecular weights of from about 150 to about 270; and condensation products of aldehydes and amines having molecular weights of from about 180 to about 320; okoumal; indole, and mixtures thereof and being essentially free from nitromusks and halogenated fragrance materials.

13. The composition according to claim 12 wherein said perfume is at a level of from about 0.2% to about 3% and at least about 50% of said perfume is selected from the group consisting of: 2,6,10-trimethyl-9-undecen-1-al; allyl amyl glycolate; allyl-3-cyclohexyl propionate; 3-methyl-1-butanol acetate; amyl salicylate; 4-methoxy benzaldehyde; condensation; product of methyl anthranilate and hydroxycitronellal; 2-ethyl-4-(2,2,3-trimethyl-3-cyclopenten-1-yl)-2-buten-1-ol; benzaldehyde; benzophenone; benzyl acetate; benzyl salicylate; 1-(2,6,6-trimethyl-1-cyclo-hexen-1-yl)-2-buten-1-one; 3-hexen-1-ol; 1,5-dimethyl-oxime bicyclo[3,2,-1]octan-8-one; octahydro-3,6,8,8-tetramethyl-1H-3A, 7-methanoazulen-6-ol; dodecahydro-3 A, 6,6,9A-tetramethylnaphtho [2,1 B]-furan; cis-3-hexenyl acetate; beta, gamma-hexenyl salicylate; 3,7-dimethyl-6-octenol; geranyl nitrile; coumarin; cyclohexyl salycilate; 2-methyl-3-(para iso propyl phenyl)propionaldehyde; decyl aldehyde; 1-(2,6,6-trimethyl-3-cyclo-hexen-1-yl)-2-buten-1-one; 3-methylene-7-methyl octan-7-ol; dimethyl benzyl carbinyl acetate; ethyl vanillin; ethyl-2-methyl butyrate; ethylene tridecan -1,13-dioate; 1,8-epoxy-paramenthane; 4-allyl-2-methoxy phenol; cyclopentadecanolide; dihydro-nor-cyclopentadienyl acetate; 3-(3-isopropylphenyl) butanal; dihydro-norcyclopentadienyl propionate; 1,3,4,6,7,8-hexahydro-4,6,6,7,8,8-hexamethylcyclopenta-gamma-2-benzopyrane; 4-N-hepty-4-hydroxybutanoic acid lactone; 4-N-octyl-4-hydroxybutanoic acid lactone; 3,7-dimethyl-2,6-octadien-1-ol; 3,7-dimethyl-2,6-octadien-1-yl acetate; 3,7-diemthyl-2,6-octadienenitrile; alpha-methyl-3,4, (methylenedioxy) hydrocinnamaldehyde; heliotropin; hexyl acetate; alpha-n-hexyl cinnamic aidehyde; hexyl salicylate; 2-cyclododecylpropanol; hydroxycitronellal; 2,3-benzopyrrole; 4-(2,6,6-trimethyl-1-cyclohexenyl-1-yl)-3-buten-2-one; 4-(2,6,6-trimethyl-1-cyclohexen-1-yl)-3-butene-2-one; 4-(2,6,6-trimethyl-2-cyclohex -1-yl) -3-methyl -3-buten-2-one; 7-acetyl-1,2,3,4,5,6,7,8-octahydro-1,1,6,7,-tetramethyl naphthalene; 2-methoxy-4-(1-propenyl)phenol; 2-methyl-3-(2-pentenyl)-2-cyclopenten-1-one; acetyl di iso amylene; lauric aidehyde; lavender; lavendin; sandalwood; patchouli; lemon oil, cold pressed; 1-methyl-4-iso-propenyl-1-cyclohexene; 3-hydroxy-3,7-dimethyl-1,6-octadiene; 3-hydroxy-3,7-dimethyl-1,6-octadiene acetate; 2,4-dihydroxy-3,6-dimethyl benzoic acid methyl ester; 4-(4-hydroxy-4-methyl-pentyl) 3-cylcohexene-1-carboxaldehyde; 2,2-dimethyl-3-(3-methylphenyl)-propanol; 4-(1-methylethyl) cyclohexane methanol; methyl-2-aminobenzoate; methyl beta naphthyl ketone; methyl cedrenyl ketone; 1-methyloxy-4,2-propen-1-yl benzene; methyl dihydro jasmonate; methyl nonyl acetaldehyde; 4-acetyl-6-tert butyl-1,1-dimethyl indane; 2-cis-3,7-dimethyl-2,6-octadien-1-ol; 4-hydroxynonanoic acid, lactone; 1-(2,2,6-trimethyl-cyclohexyl)-3-hexanol; 1,3-dioxolane-2,4-dimethyl-2-(5,6,7,8-tetrahydro-5,5,8,8-tetramethyl-2-naphthalenyl)-cis-ketal; orange oil, cold pressed; 2-methyl-3(para tert butylphenyl) propionaldehyde; para hydroxy phenyl bumone; 1-oxo-2-phenylethane; phenyl acetaldehyde dimethyl acetal; phenyl ethyl acetate; phenyl ethyl alcohol; 2-phenylethyl phenyl acetate; 3-methyl-5-phenylpentanol; 3,3-dimethyl-5-(2,2,3-trimethyl-3-cyclopenten-1-yl) -4-penten-2-ol; 2-methylbuten-2-ol-4-acetate; 2-methyl-5-pentanol; 1-methyl-4-iso-propylcyclohexadiene-1,3; para-menth-1-en-8-ol, para-menth-1en-1-ol; para-menth-1-en-8-yl acetate; 3,7-dimethyl-3-octanol; 2,6-dimethyl-2-octanol; 7-acetyl-1,1,3,4,4,6-hexamethyl tetralin; 4-N-heptyl-4-hydroxybutanoic acid lactone; 4-methyl-3-decen-5-ol; undecanal; undecylenic aidehyde; 4-hydroxy-3-methoxybenzaldehyde; 2-tert-butyl cyclohexanyl acetate; 4-tertiary-butyl cyclohexyl acetate; and mixtures thereof.

14. The composition of claim 13 wherein at least about 75% of said perfume is composed of the named group, and the level of the perfume is from about 0.3% to about 2%.

15. A fabric conditioning composition according to claim 13 comprising:

(a) from about 1% to about 80% of fabric softening agents of the formula:

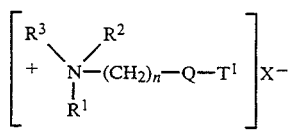

(I)

or

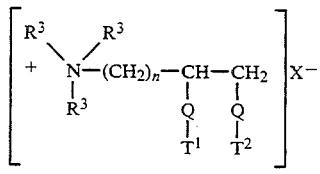

(II)

Q is—O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

each $T^1$, $T^2$, $T^3$, $T^4$, and $T^5$ is $C_{11}$–$C_{22}$ alkyl or alkenyl;

n and m are integers from 1 to 4; and $X^-$ is a softener-compatible anion; and (b) from about 5 CEVU/gram to about 125 CEVU/gram, by weight of the composition, of a cellulase consisting essentially of a homogeneous endoglucanase component, which is immunoreactive with an antibody raised against a highly purified 43 kD cellulase derived from *Humicola insolens,* DSM 1800, or which is homologous to said 43 kD endoglucanase; and wherein the composition has a pH measured on the composition itself, at 20° C., of from about 2.0 to about 4.5.

16. The composition according to claim 15 wherein the quaternary ammonium softening agent is N,N-di(2-tallowoyl-oxy-ethyl)-N,N-dimethyl ammonium chloride.

17. A process for machine treatment of fabrics, said process comprising treating fabric during a rinse cycle of a machine washing process with a rinse solution containing the composition according to claim 1.

18. A process for machine treatment of fabrics, said process comprising treating fabric during a rinse cycle of a machine washing process with a rinse solution containing the composition according to claim 2.

19. A process for machine treatment of fabrics, said process comprising treating fabric during a rinse cycle of a machine washing process with a rinse solution containing the composition according to claim 12.

20. A process for machine treatment of fabrics, said process comprising treating fabric during a rinse cycle of a machine washing process with a rinse solution containing the composition according to claim 14.

* * * * *